US005129241A

United States Patent [19]

Kiuchi et al.

[11] Patent Number: 5,129,241

[45] Date of Patent: Jul. 14, 1992

[54] CONTROL APPARATUS FOR WASHING MACHINE

[75] Inventors: Mitsuyuki Kiuchi, Nara; Sadayuki Tamae, Osaka; Hisayuki Imahashi; Shoichi Matsui, both of Kawanishi, all of Japan

[73] Assignee: Matsushita Electric Industrial Co., Ltd., Osaka, Japan

[21] Appl. No.: 721,605

[22] PCT Filed: Nov. 20, 1990

[86] PCT No.: PCT/JP90/01510

§ 371 Date: Jul. 19, 1991

§ 102(e) Date: Jul. 19, 1991

[87] PCT Pub. No.: WO91/07537

PCT Pub. Date: May 30, 1991

[30] Foreign Application Priority Data

Nov. 20, 1989 [JP] Japan ..... 1-302954

[51] Int. Cl.[5] ..... D06F 33/02

[52] U.S. Cl. ..... 681/12.04; 68/12.02; 68/12.27

[58] Field of Search ..... 68/12.02, 12.04, 12.27

[56] References Cited

U.S. PATENT DOCUMENTS 4,222,250 9/1980 Torita .

FOREIGN PATENT DOCUMENTS 2485576 12/1981 France .

0119989 6/1985 Japan ..... 68/12.02

0284293 12/1986 Japan ..... 68/12.02

*Primary Examiner*—Philip R. Coe

*Attorney, Agent, or Firm*—Lowe, Price, LeBlanc & Becker

[57] ABSTRACT

The present invention relates to a control apparatus for a washing machine, which judges the type of dirt and quantity of dirt, etc. in laundry items to be washed, to thereby ensure optimum results for the finished washed items. In addition, control of washing is executed by judgement operations executed at high speed, to enable highly accurate real-time control. The apparatus is provided with a transmission factor detection apparatus (19) for detecting the optical transmission factor of the washing liquid within a tub of the washing machine. The optical transmission factor detected by the transmission factor detection apparatus (19) and the duration of a saturation interval, which elapses from the start of washing until a condition of saturation of the optical transmission factor is attained, are used as information representing the type of dirt and quantity of dirt, etc. A microcomputer (16) determines the duration of a washing operation, etc., from control tables, by using the saturation interval and optical transmission factor.

7 Claims, 6 Drawing Sheets

CONTROL APPARATUS FOR WASHING MACHINE

FIELD OF TECHNOLOGY

The present invention relates to a control apparatus for a washing machine, which includes a transmission factor detection apparatus for detecting the optical transmission factor of the washing liquid within a tub of a washing machine (where the term "ashing liquid" as used herein signifies a mixture of water and a cleanser), and which controls the washing operation by judging a degree of dirtiness, based an output signal from the transmission factor detection apparatus.

BACKGROUND TECHNOLOGY

Japanese Oatent No. 63/16157 describes a prior art example of a control apparatus for a washing machine, which is provided with a transmission factor detection apparatus for detecting the degree of dirtiness of the washing liquid within the tub of the washing machine. That control apparatus consists of the transmission factor detection apparatus, which detects the optical transmission factor of the washing liquid within the tub, and a judgement section for detecting changes in that optical transmission factor, as indicated by an output signal from the transmission factor detection apparatus, while a washing operation is in progress. When the optical transmission factor of the washing liquid is found to have ceased to change, the judgement section judges that as indicating that the washing operation is to be ended. When the judgement section thus judges that the washing oepration is to be ended, then after halting the washing operation, the discharge valve of the washing machine is opened, and the washing liquid is discharged through a discharge pipe. During that discharge process, the optical transmission factor of the washing liquid that is flowing through the discharge pipe is judged. Since foam which is produced in the washing operation will be mixed into the washing liquid as that liquid is being discharged, the optical transmission factor as detected by the transmission factor detection apparatus will be reduced due to dispersion of the sensing light within the foam in the discharged washing liquid. The greater the amount of foam in the washing liquid, the greater will be the degree of dispersion of the light, and hence the greater will be the amount of reduction of the optical transmission factor that is detected by the transmission factor detection apparatus. Thus be detecting the amount of lowering of optical transmission factor which occurs during the washing liquid discharge operation, it is possible to detect the amount of foam in the washing liquid, and hence to detect the proportion of cleanser that remains in the washing liquid, so that the degree of washing power that remains in the washing liquid can be detected. The amount of lowering of the optical transmission factor during the washing liquid discharge operation is compared with a judgement amount, and if the amount of lowering is not to be sufficiently small, then a warning indication is given that the washing process has been insufficient.

With such a control apparatus for a washing machine, since the optical transmission factor is detected by the transmission factor detection apparatus during a washing operation, and the point in time at which changes in the optical transmission factor are found to have ended is taken as the point at which the washing operation is to be terminated, the problem arises that the degree of washing that has been performed may be insufficient in some cases. For example if the type of dirt that is to be removed is mud, then the changes in optical transmission factor will end within a short time, i.e. the mud will dissolve in the washing liquid within a short time, so that the changes in optical transmission factor will correspondingly be ended within a short time. However at that point in time, there may still remain some types of dirt such as mud or grease etc., adhering to the material being washed, so that the degree of washing will have been insufficient.

Moreover with such an apparatus, if it is judged by the apparatus after the washing operation has ended that the degree of washing was not sufficient, then a warning indication is issued to inform the user that the washing operation must be repeated. In such a case, the user must then again repeat the washing operation, which is inconvenient and is a problem of that apparatus.

SUMMARY OF THE INVENTION

It is a first objective of the present invention to overcome the above problems, by providing a control apparatus for a washing machine whereby a sufficient degree of washing is executed even in the case when the dirt that is to be removed is a material such as mud, which results in changes in the optical transmission factor ceasing within a short time, and whereby the washing operation is not terminated until sufficient degree of washing has been achieved, so that there is no need to repeat the washing oepration, and hence the convenience of use is increased.

It is a second objective of the present invention to ensure that the first objective set out above will be attained even when different types of cleanser are used.

It is a third objective of the present invention to ensure that the first objective set out above will be attained even when a sensor portion of a transmission factor detection apparatus of the control apparatus for a washing machine has become coated with accumulated dirt, over a long period of use.

It is a fourth objective of the present invention to ensure that the first objective set out above will be attained even when various different quantities of material are washed.

To achieve the first objective set out above, the present invention provides a control apparatus for a washing machine comprising:

a transmission factor detection apparatus for detecting an optical transmission factor of a washing liquid in a tub of a washing machine;

saturation detection means for detecting a saturation condition, based on changes of an output signal produced from the transmission factor detection apparatus;

time measurement means for measuring a saturation interval which elapses from the start of a washing operation until the saturation condition is detected by the saturation detection means;

control means for controlling a washing operation by controlling electrical power supplied to an agitation vane drive motor; and memory means for storing a control table for determining a washing operation time interval duration, a cleanser insertion quantity, or a strength of water currents, based upon the saturation interval and the optical transmission factor;

in which the control means compares the optical transmission factor and the saturation interval with the contents of the control table held in the memory means, to determine the washing operation interval, the cleanser insertion quantity, or the strength of water currents.

With the above configuration, the saturation interval constitutes information concerning the type of dirt, i.e. if the dirt consists of mud then the saturation interval will be short, while if the dirt consists of grease then the saturation interval will be long. In addition, the optical transmission factor constitutes information concerning the quantity of dirt which has been dissolved out into the washing liquid. Thus if the washing operation interval duration is based on these two types of information, that interval can be determined in accordance with the type of dirt (e.g. in accordance with whether the material to be washed is soiled with mud), and also in accordance with the quantity of that dirt. Thus the washing machine can be controlled for an optimum washing opoeration interval which provides satisfactory results for the finally washed material.

It is preferable to use fuzzy inference for determining the washing operation, based upon the saturationinterval (which serves as information concerning the type of dirt which is to be removed) and the optical transmission factor (which serves as information concerning the quantity of that dirt). That is to say, the optimum washing operation conditions for a particular type of dirt and qunatity of dirt can be based upon data obtained from human experience. However since such data is only vaguely expressed, it is preferable to use fuzzy inference, in conjunction with such vaguely expressed human judgement data, to replace the saturation interval and optical transmission factor information with data that can be used to determine the washing operation conditions. However in order to use fuzzy inference, it is usually necessary to use a specific program for that purpose. It is difficult to execture such a fuzzy inference program using a normal type of microcomputer which employs a word length of 4 to 8 bits. In addition, a significant amount of time is required to execute fuzzy inference operations, so that the problem also arises that the necessary washing operation interval duration cannot be determined by real-time operation, if such a fuzzy inference program is executed to obtain that interval duration. However with the present invention, fuzzy inference is applied to the optical transmission factor and the saturation interval by using a control table which is stored in a memory. That control table contains peviously established values for the washing operation interval duration in relation to values of saturation interval and ooptical transmission factor, so that the washing operation interval value can be directly obtained from the control table without the need to execute a fuzzy inference program to determine the washing operation interval. Thus, the approiate value of washing operationinterval can be obtained by real-time operation. It should be noted that such a method of using a control table is not limited to the case of fuzzy inference control, but could equally well be applied if some other type of complex calculations are executed, based on the obtained values of optical transmission factor and saturation interval, to determine the washing operation interval, with similar results being obtainable.

Furthermore, due to the fact that the cleanser insertaion quantity is determined based on the satuartion interval and the optical transmission factor, a satisfactory degree of cleanness of the finished washed material can be achieved by inserting additional amounts of clanser in cases where the amount of dirt in the material to be washed is excessively high. This prevents an insufficient degree of washing from being applied, as might otherwise result.

In addition, due to the fact that the strength of the waster currents in the tub are changed in accordance with the saturation interval and the optical transmission factor, the water current strength can be controlled such as to be matched to the type of dirt and the quantity of dirt in the material that is being washed.

In order to achieve the second objective set out above, the present invention provides an apparatus in which a plurality of control tables in accordance with respective types of cleanser are stored in memory means, and in which the control means selects a control table from the memory means in accordance with an output signal from a cleanser judgement means, to control the washing duration, the cleanser insertion quantity, or the strength of water currents.

The optical transmission factor of the washing liquid will greatly differ, for the same amount of dirt in the washing liquid, in accordance with differences in the type of cleanser that is used, e.g. in accordance with whether a liquid cleanser or a powder cleanser is used. Hence, with the above configuration of the present invention, a plurality of control tables (each for determining the washing operation interval duration in accordance with the obtained values of optical transmission factor and saturation interval) are provided, these control tables being respectively in accordance with different types of cleanser.

Thus, irrespective of changes in the optical transmission factor resulting from use of different types of cleanser, a sufficient degree of accuracy of control of the washing operation interval, of the cleanser insertion quantity, and of the strength of water currents can be achieved.

To achieve the third of the objectives set out above, the present invention provides an apparatus in which the transmission factor detection apparatus comprises a photo-emitter element, a photo-receptor element, and light emission output control means, and in which the control means set in operation the light emission output control means under a condition of clear water within the tub, and sets an output signal produced from the photo-receptor element to a standard value.

Due to the above configuration, the light output that is produced from the photo-emitter element is controlled such that the output signal produced from the photo-receptor element attains a fixed value under a condition in which clear water is being detected. As a result, even if dirt accumulates in the detection section of the transmission factor detection apparatus, a fixed level of output will always be obtained from the photo-receptor element under a condition in which clear water is being detected. Hence, highly accurate values for the saturation interval and the optical transmission factor can be obtained, irrespective of any accumulation of dirt upon the detection section.

To achieve the fourth objective set out above, the present invention comprises wash quantity detection means for detecting an amount of laundry items which are to be washed within the tub, wash quantity judgement means for classifying a value of quantity of the laundry items obtained by the wash quantity detection means within a plurality of stepwise-varying values, in which a plurality of control tables are stored in memory means respectively in accordance with the stepwise-varying values of quantity, and in which the control means selects the control tables in accordance with an output signal produced from the wash quantity judgement means, and determines the washing operation duration, the cleanser quantity insertion amount, or the strength of water currents.

Due to the above configuration, a control table can be selected that is suitable for the actual quantity of material that is to be washed, so that high accuracy can be achieved for the various controlled parameters, irrespective of the amount of material that is to be washed.

DESCRIPTION OF PREFERRED EMBODIMENTS

Figure 1:
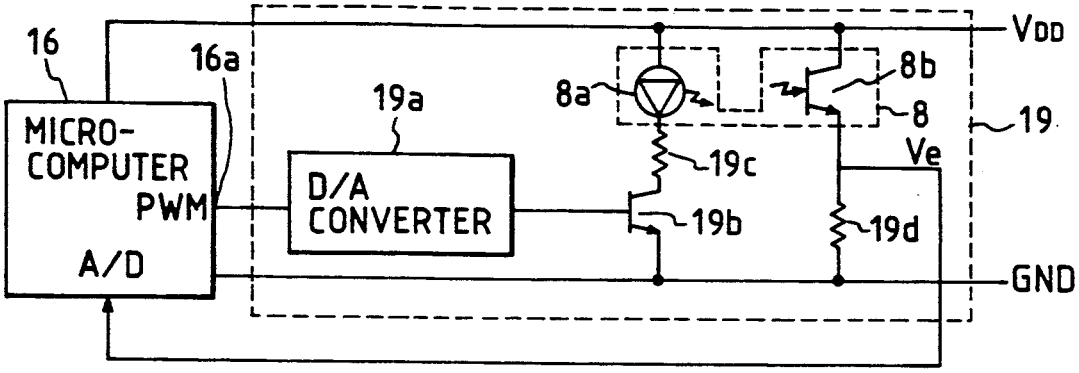
FIG. 1 is a block diagram of a first embodiment of a transmission factor detection apparatus according to the present invention.

FIG. 1 is a block diagram showing an embodiment of a transmission factor detection apparatus according to the present invention. In FIG. 1, numeral 8 denotes an optical sensor, which includes a photo-emitter element 8*a* and a photo-receptor element 8*b* which are disposed mutually opposing, with output light produced from the photo-emitter element 8*a* being held constant and the level of output signal produced from the photo-receptor element 8*b* being detected to thereby detect dirt within the washing liquid in the tub. The level of output light produced from the photo-emitter element 8*a* is controlled by an output signal produced from a microcomputer 16, which is a pulse width modulation (hereinafter abbreviated to PWM) signal. The PWM signal produced from the microcomputer 16 is converted to a DC voltage by a D/A converter 19*a*. That DC voltage is applied as the base voltage of an NPN transistor 19*b* which has the photo-emitter element 8*a* connected to its collector electrode, to thereby control the current of the NPN transistor 19*b* and hence the level of light produced from the photo-emitter element 8*a*, in accordance with the level of output voltage from the D/A converter 19*a*.

A light emission control circuit is formed by the D/A converter 19*a* and the NPN transistor 19*b*. An emitter resistor 19*c* is connected to the emitter of the transistor 19*b*, for supplying a stable current to the photo-emitter element 8*a*. The photo-receptor element 8*b* has an emitter resistor 19*d*, from which an output voltage $V_e$ is produced, and is supplied to an A/D converter input terminal of the microcomputer 16. When the water within the tub of the washing machine is clear, then the microcomputer 16 causes the photo-emitter element 8*a* to produce a level of output light such that a reference level $V_s$ is produced as the output voltage $V_e$ from the photo-receptor element 8*b*. When the level of output voltage from the photo-receptor element 8*b* has thus been set as the standard value $V_s$, the level of light emission from the photo-emitter element 8*a* is thereafter held fixed. Thus, changes with time in the value of the signal voltage $V_e$ from the standard value $V_s$ are detected as indicating changes in the optical transmission factor. That is to say, the condition in which the standard value $V_s$ is outputted as the voltage $V_e$, indicating the degree of optical transmission factor of 100%, occurs when there is a condition of clear water. Thus the optical transmission factor is obtained as the ratio of the output voltage $V_e$ to $V_s$, i.e. as $V_e/V_s$.

Figure 2:
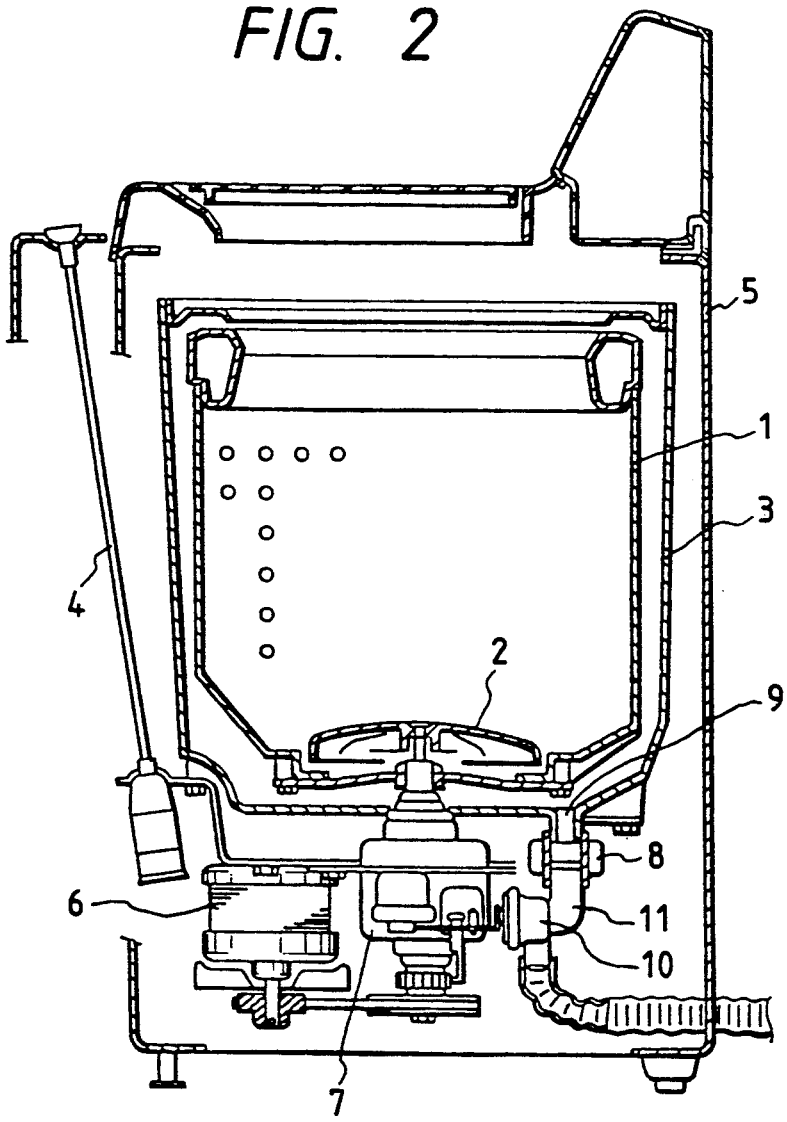
FIG. 2 is a cross-sectional view showing the structure of an embodiment of a washing machine according to the present invention.

FIG. 2 shows an example of a configuration for a washing machine according to the present invention. In FIG. 2, numeral 1 denotes a washing and water extraction tub, having agitator vanes 2 at the lower part thereof, which are rotated during washing and rinsing intervals. In addition, during water extraction, the agitator vanes 2 and the washing and water extraction tub 1 are rotated together. Numeral 3 denotes an outer tub, which receives the washing liquid during a washing operation or a rinsing operation. Numeral 4 denotes a suspension member for retaining components such as the tub 3 etc, and 5 denotes an outer case of the washing machine. Numeral 6 denotes a motor, which drives the agitator vanes 2 and the washing and water extraction tub 1 through a speed reduction mechanism 7. Numeral 9 denotes a discharge aperture, disposed at the lower part of the washing and water extraction tub 1, which communicates with a discharge pipe 11. The discharge pipe 11 is connected to a discharge valve 10, and is provided with the photo-sensor 8 which constitutes the sensing section of the transmission factor detection apparatus 19. The photo-sensor 8 serves to detect the optical transmission factor of the washing liquid in the lower part of the tub 3, and also to detect the optical transmission factor of the washing liquid in the discharge pipe 11 which is connected to the discharge valve 10, for thereby detecting the degree of dirtiness of the laundry items which are being washed, or the water extraction condition.

Figure 3:
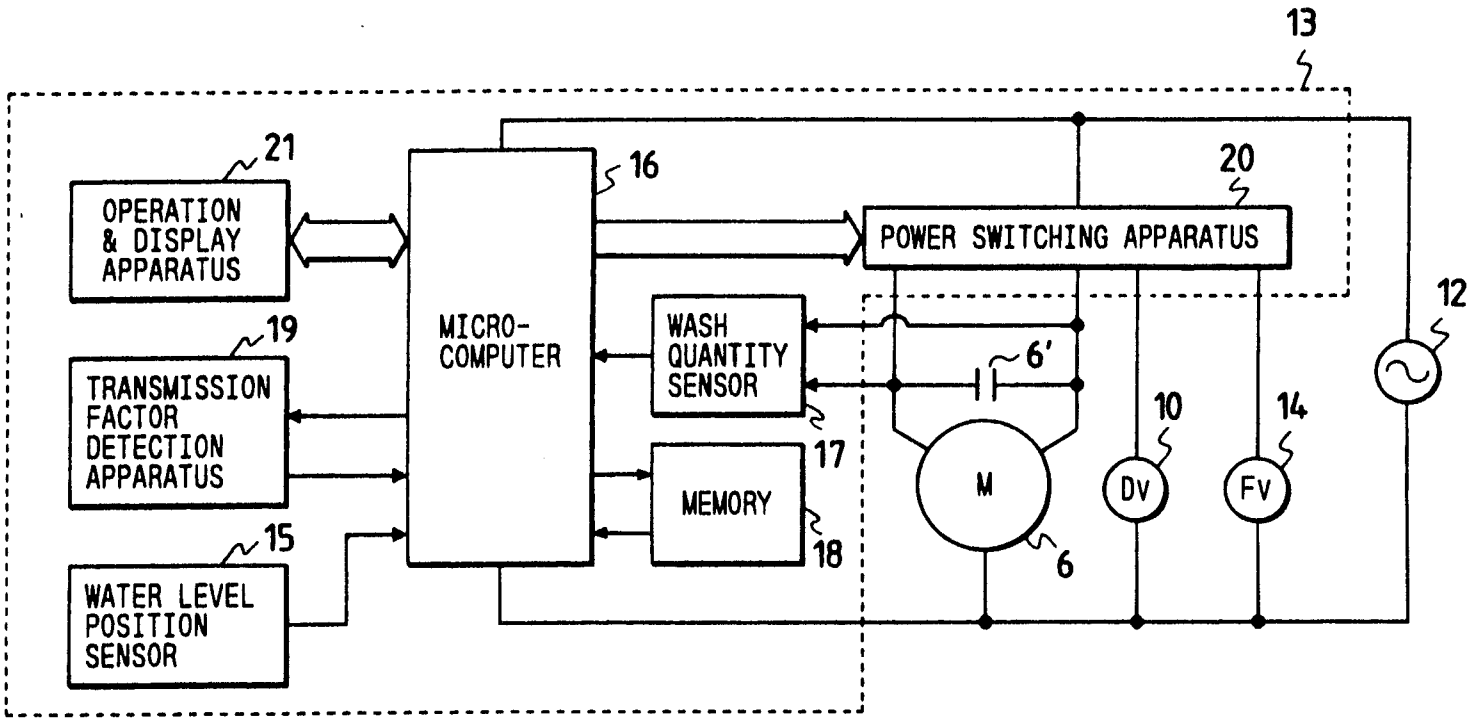
FIG. 3 is a block diagram of a control apparatus for a washing machine according to the present invention.

FIG. 3 is a block diagram of a control apparatus for a washing machine according to the present invention. In FIG. 3, an AC power supply voltage is applied from a source 12 to the control apparatus 13, which controls a load consisting of the motor 6, discharge valve 10 and a water supply valve 14. A phase advance capacitor 6' is provided for the motor 6. Numeral 15 denotes a water level sensor for detecting the level of washing liquid within the tub 3, 16 denotes the microcomputer, 17 denotes a wash quantity sensor for detecting the amount of the laundry items which are to be washed. The wash quantity sensor 17 functions by switching the motor 6 on and off, to successively rotate the agitator vanes 2 in the clockwise direction, halt the rotation, and rotate in the counterclockwise direction, and determines the amount by which the agitator vanes 2 continue to rotate after the agitator vanes 2 has been switched off, to thereby judge the quantity of the laundry items that are to be washed. That is to say, if the amount of laundry items is small, then there will be little obstruction of continued rotation of the agitator vanes 2 resulting from rotational inertia, so that the agitator vanes 2 will continue to rotate through a relatively large number of revolutions after the motor is switched off. In that case, a large number of succesively damped pulses will be produced across the phase advance capacitor 6' after the motor 6 is switched off. Conversely, if the quantity of the laundry items to be washed is large, then only a small number of these succesively damped pulses will be produced across the phase advance capacitor 6' after the motor 6 is switched off. These characteristics are used to detect the quantity of the laundry items to be washed. Numeral 18 denotes a memory circuit, in which can be written (and from which can be read out) control data for the transmission factor detection apparatus 19 and standard set values, etc. Numeral 20 denotes a power switching device, which controls the power supplied to the load consisting of the motor 6, the discharge valve 10, the water supply valve 14, etc, in accordance with control signals supplied from the microcomputer 16. Numeral 21 denotes an operating and display apparatus which includes various switches and display devices, whereby the user can input designation signals and whereby indications can be displayed to the user.

Figure 4:
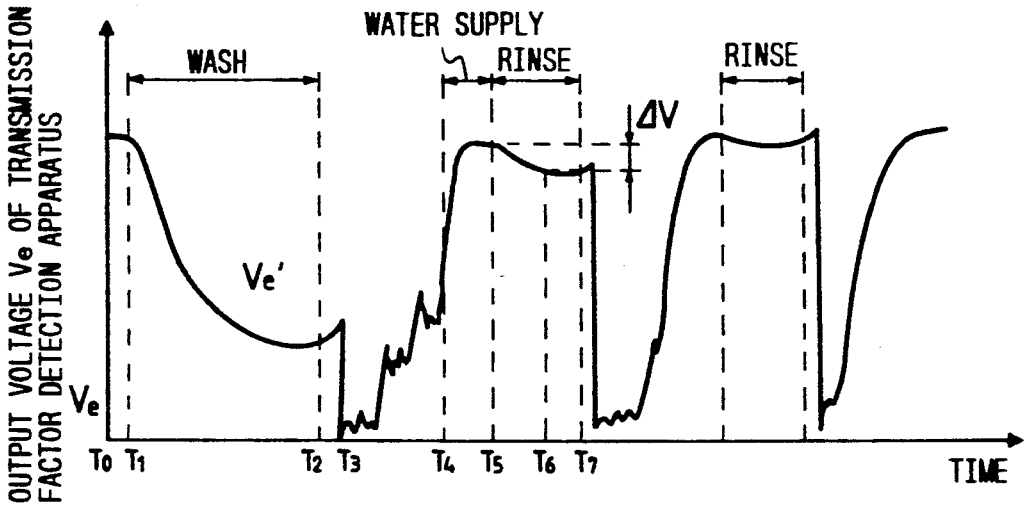
FIG. 4 shows changes in an output signal from a transmission factor detection apparatus according to the present invention, during a washing operation interval, rinsing interval, and water extraction interval.

FIG. 4 is a waveform diagram showing the changes which occur in the output voltage $V_e$ from the transmission factor detection apparatus 19 during the washing interval, rinse interval, and discharge interval. In the interval from T1 to T2 washing is executed, in the interval from T2 to T3 discharging is executed, in the interval from T3 to T4 intermediate water extraction is executed, in the interval from T4 to T5 water is supplied, and in the interval from T5 to T7 rinsing and agitation are executed. Adjustment control of the emitted light output for the transmission factor detection apparatus 19 is executed during the water supply interval from T4 to T5, following the intermediate water extraction and prior to the rinsing, for setting the output voltage $V_e$ of the transmission factor detection apparatus 19 to the standard value $V_s$. At that time, the water in the vicinity of the discharge pipe 11 is substantially completely clear, so that the optical transmission factor can be considered to be 100%. As a result of that adjustment operation, the output voltage $V_e$ from the transmission factor detection apparatus 19 will be set at the standard value $V_s$ irrespective of any dirt which may be deposited on the inner wall of the discharge pipe 11, so that the degree of subsequent change of the voltage $V_e$ from that standard value $V_s$ indicates the degree of dirtiness of the washing liquid during a washing operation or of washing liquid being discharged during a water extraction interval. Control data for determining the level of light emission by the transmission factor detection apparatus 19, which have been set during that water supply interval, or the sensor voltage $V_e$ (which is almost identical to $V_s$), are then stored in the memory 18. These control data are subsequently used in a rinse interval, and thereafter in the next washing operation and intermediate water extraction. During a fixed interval which elapses from the start of the rinse agitation (T5) to the time point T6, the degree of lowering of optical transmission factor of the washing liquid is detected as an amount of change of the output voltage from the transmission factor detection apparatus 19, and the result is used to control the motor rotation during the subsequent rinse operation. If a large amount of water is used in the washing operation, then washing liquid will flow through the discharge pipe during the intermediate water extraction interval, which will result in a lowering of the optical transmission factor during that interval, as shown in FIG. 4.

Figure 5:
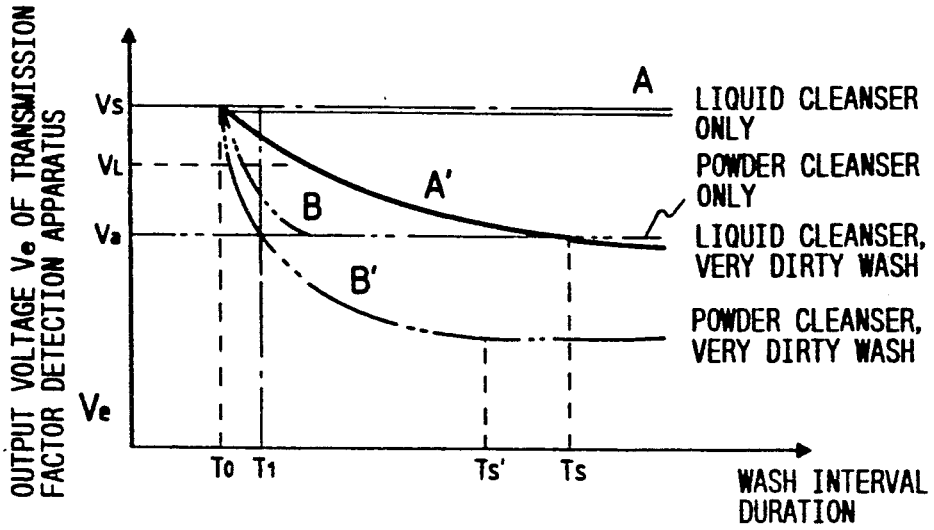
FIG. 5 shows the effects of different types of cleanser, during the washing operation interval.

FIG. 5 shows the variation of the output voltage $V_e$ of the transmission factor detection apparatus 19 during a washing operation interval. Washing agitation is started from the time point T0. If for example laundry items which are free from dirt, and a liquid cleanser, have inserted into the water in the tub 3, or if only a liquid cleanser has been inserted, then there will be almost no change in the value of $V_e$, as indicated by the characteristic A. If the laundry items are extremely dirty, then the value of $V_e$ will gradually fall from the standard value $V_s$, as indicated by the curve A'. If laundry items that are free from dirt, and a powder cleanser, are inserted into the water in tub 3, or if a powder cleanser alone is inserted, then the value of $V_e$ will vary with time as shown by the curve B. This will reach a saturation value $V_a$. If laundry items that are extremely dirty, and a powder cleanser, are inserted into the water in the tub 3, then the voltage $V_e$ will vary as shown by curve B'. This will also reach a saturation value at which no further changes in $V_e$ will occur, at a time $T_s$. The time required from the start of the washing operation until that saturation condition is reached is called the saturation interval. By detecting the duration of that saturation interval, it becomes possible to judge whether the dirt consists of mud or consists of grease. That is to say, if the laundry items to be washed are soiled with mud, then the dirt will rapidly dissolve in the washing liquid, so that the duration of the saturation interval will be short. Conversely, if the dirt consists of grease, then this will not dissolve so readily in the washing liquid, so that the saturation interval will be longer. In addition, for the same type of dirt, the saturation interval duration will differ in accordance with whether a powder cleanser or a liquid cleanser is used. Due to the fact that the cleansing performance of a liquid cleanser is lower than that of a powder cleanser, a greater amount of time is required to dissolve the dirt if a liquid cleanser is used, so that the saturation interval duration will be increased. Thus the type of cleanser that is used will have an effect upon the saturation interval and the level of output voltage $V_e$ from the transmission factor detection apparatus 19, so that it is desirable for the apparatus to be able to judge the type of cleanser that is being used.

The method of judging the type of cleanser that is being used will be described in the following. Immediately after the start of a washing operation, at time point T1, the output voltage $V_e$ of the transmission factor detection apparatus 19 is detected, and is compared with a voltage level $V_L$. THe value of $V_L$ is selected to be slightly higher than the level $V_a$ which (as shown in FIG. 5) would be produced from the transmission factor detection apparatus 19 at the time point T1 if a powder cleanser alone is mixed in the wash water. If it is found that $V_e$ is greater than $V_L$, then this is judged to indicate that a liquid cleanser is being used, whereas if $V_e$ is found to be less than or equal to $V_L$ then this is judged as indicating that a powder cleanser is being used. If it has thus been judged that a liquid cleanser is being used, then the changes in the value of the output voltage $V_e$ from the voltage level $V_s$ will be used as an indication of changes in dirtiness of the laundry items being washed. If however it has thus been judged that a powder cleanser is being used, then the changes in the value of the output voltage $V_e$ from the voltage level $V_a$ will be used as an indication of changes in dirtiness of the laundry items being washed. That is to say, if it has been judged that a liquid cleanser is being used, then the greater the value of the difference $(V_s-V_e)$, the greater will be the estimated degree of dirtiness of the laundry items being washed. However if it has been judged that a powder cleanser is being used, then the greater the value of the difference $(V_a-V_e)$, the greater will be the estimated degree of dirtiness of the laundry items being washed. Generally speaking, $V_a$ is approximately 60 to 65% of $V_s$.

Figure 6:
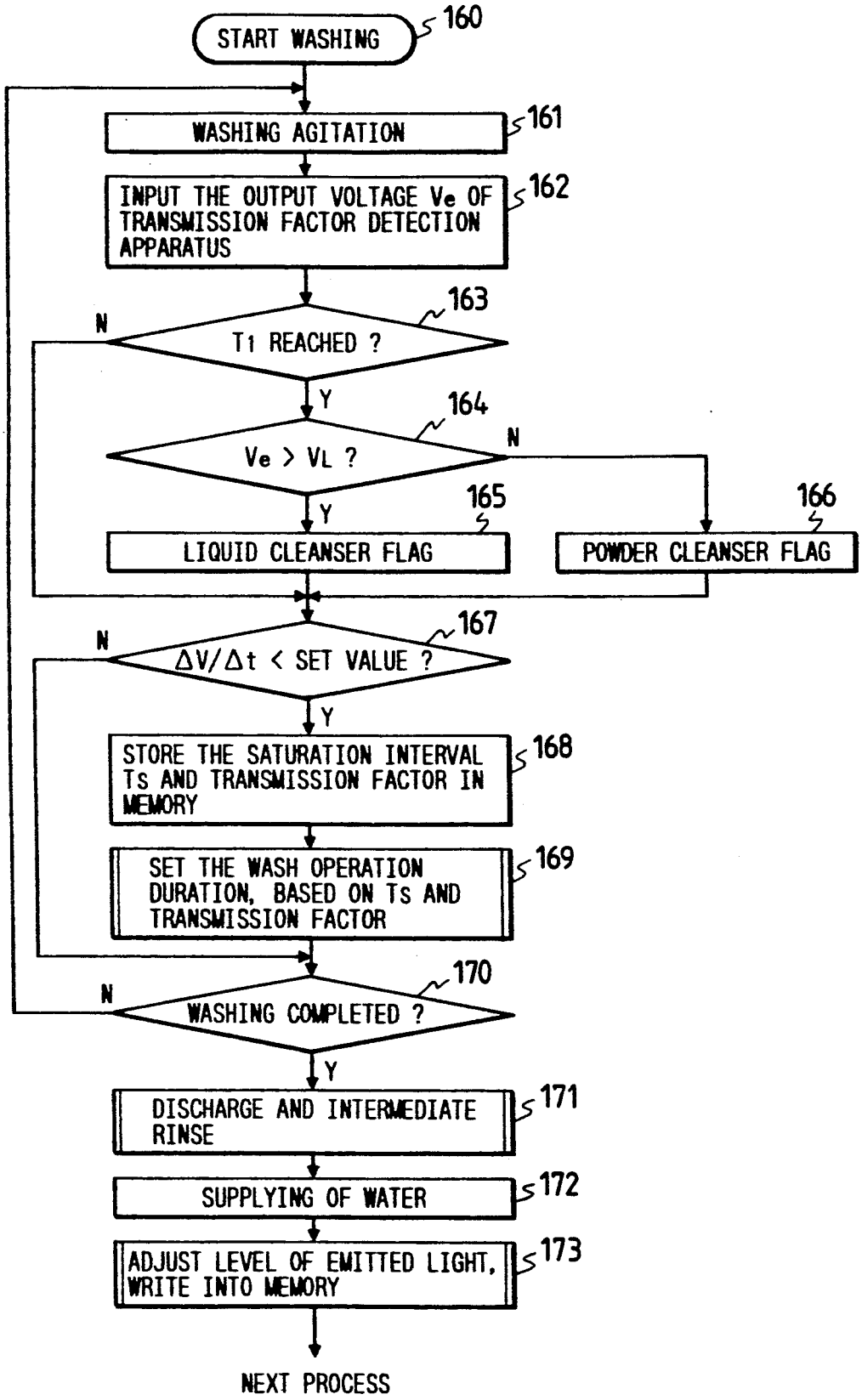
FIG. 6 is a general flow chart illustrating washing control according to the present invention.
Figure 7:
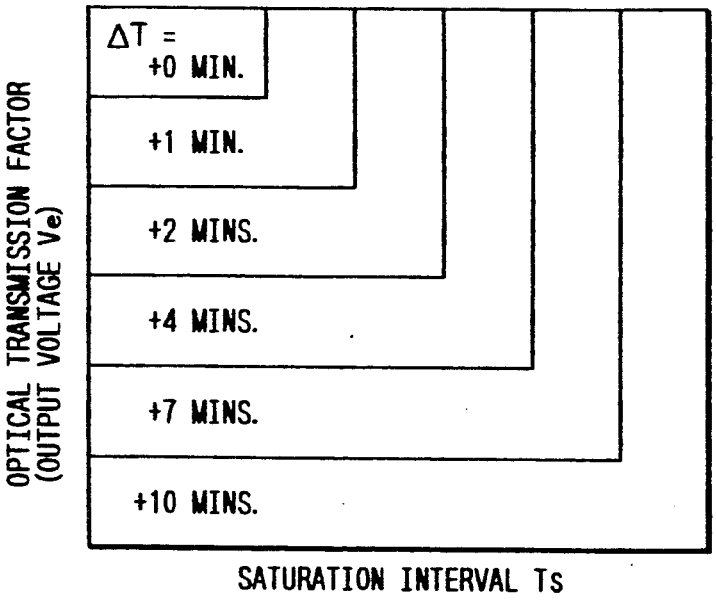
FIG. 7 shows an example of a washing control table.

FIG. 6 is a flow chart for describing the washing control of this embodiment. In step 160, washing is started, and in step 161 the rotation of the washing agitator vanes is started. In step 162, the degree of light output produced from the transmission factor detection apparatus 19 is set to a fixed value, based on light emission control data that have been stored beforehand in the memory 18. Thereafter, the value of the output voltage $V_e$ of the transmission factor detection apparatus 19 is periodically inputted to the microcomputer 16. If it is found in step 163 that 2 to 3 minutes have elapsed following the agitation starting time point T1, then in step 164 it is judged whether the output voltage $V_e$ of the transmission factor detection apparatus 19 is higher than the liquid cleanser adjustment level $V_L$. If $V_e$ is found to be higher than that liquid cleanser level, then this indicates that a liquid cleanser is being used, while if $V_e$ is found to be lower than the liquid cleanser level than this indicates that a powder cleanser is being used. The condition which has thus been detected is then memorized by setting a corresponding control flag, for use in subsequent washing and rinsing operations. Next in step 167 a judgement is made as to whether the output voltage change $(\Delta V/\Delta t)$ of the transmission factor detection apparatus 19 is smaller than a predetermined set value. If the output voltage change is found to be smaller than the set value, then this indicates that the saturation condition has been reached, and so the saturation interval $T_s$ and the optical transmission factor at that point (i.e. the level of the output voltage $V_e$) are stored in memory, and are thereafter used for control data. In step 169, the duration of the washing operation interval is determined in accordance with the value of the saturation interval $T_s$ and the optical transmission factor. There are control tables stored in the memory of the microcomputer for that purpose, and FIG. 7 illustrates such a control table or function table, which is referred to for obtaining a value of additional wash interval. The duration of the washing operation interval $T_w$ is obtained as $T_s+\Delta T$, where $\Delta T$ is the amount of additional wash interval. In the example of FIG. 7, the value of additional wash interval $\Delta T$ varies in accordance with the weights of the optical transmission factor and the saturation interval $T_s$. The lower the optical transmission factor and the longer the value of $T_s$, the greater becomes the value of $\Delta T$. Different weighting factors must be assigned for the case of a liquid cleanser and a powder cleanser respectively being used. For simplicity, FIG. 7 shows an example only for the case of a liquid cleanser. A separate control table is prepared for use in the case of a powder cleanser, with the appropriate table being selected in accordance with the type of cleanser that has been judged to be used. If the degree of dirtiness of the laundry items being washed is found to exceed a level corresponding to the maximum value of $\Delta T$ provided by the table of FIG. 7, then the strength of the water currents can be increased, or, in the case of a washing machine in which an automatic cleanser insertion function is provided, the amount of cleanser that is inserted can be increased.

If it is judged in step 170 that the washing operation is to be terminated, then in step 171 an intermediate water extraction operation is executed, followed in step 172 by a water supply operation prior to rinsing. During this water supply interval, step 173 is executed, in which subroutines are executed for setting the level of emitted light of the transmission factor detection apparatus 19 and for setting control data into memory. During the subsequent rinsing operation, and during the next washing operation, the level of emitted light of the transmission factor detection apparatus 19 is controlled to be held fixed at the value that was set in step 173.

As will be clear from this flow diagram the microcomputer 16, which is the basic component of the control operation, functions to detect the saturation condition based on changes in the output signal of the transmission factor detection apparatus 19, and also functions to detect the duration of the saturation interval, which extends from the start of a washing operation until the saturation condition is detected, and in addition functions to detect the type of cleanser that is being used. Thus the microcomputer 16 includes saturation condition detection means, time measurement means, and cleanser judgement means.

The control tables serve to determine the additional wash interval T based on the duration of the saturation interval $T_s$ and on the optical transmission factor. However this additional wash interval T is preferably derived from human experience, so that it is desirable to used fuzzy inference control to replace the saturation interval $T_s$ and the optical transmission factor by vaguely defined data that has been obtained through human judgement. Normally when such fuzzy inference control is used, it is necessary to use a dedicated fuzzy inference program. However it is difficult to use the the usual type of microcomputer having a word length of 4 to 8 bits for executing a fuzzy inference program and also for executing the control program which controls the washing operation etc. Hence it is preferable to store results previously obtained by fuzzy inference in the form of a control table in a ROM of the microcomputer. It would be equally possible to use a control table in a similar manner in cases where some other difficult type of program is necessary.

Figure 8:
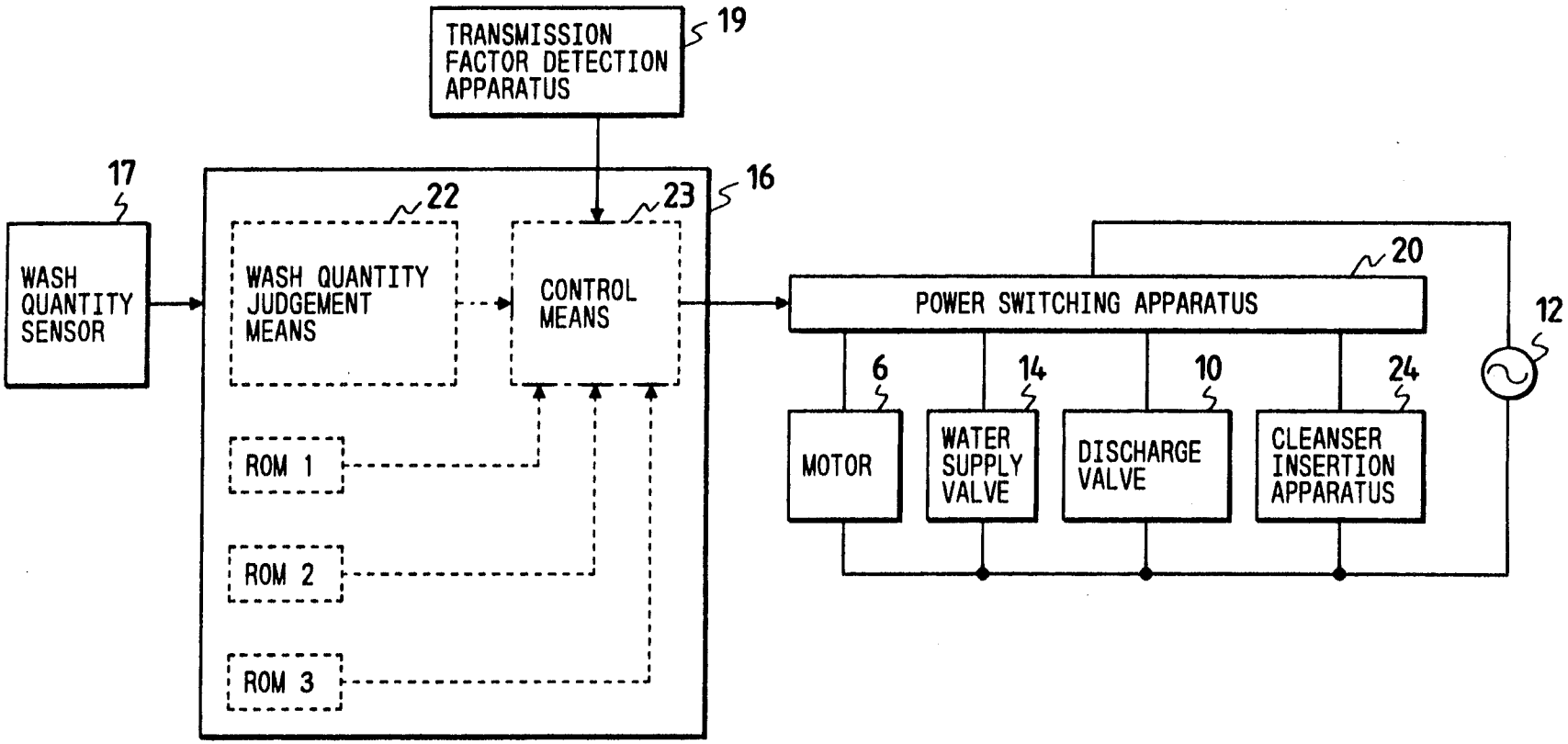
FIG. 8 is a block diagram of a second embodiment of a control apparatus for a washing machine according to the present invention.

Another embodiment of the present invention will be described referring to FIG. 8. In FIG. 8, numeral 16 denotes a microcomputer, which includes a wash quantity judgement means 22 for judging the quantity of laundry items, based on an output signal from the wash quantity sensor 17. The wash quantity judgement means 22 judges the quantity as being one of three stepped values, i.e. large, medium or small. The microcomputer 16 further includes a ROM1, ROM2 and ROM 3 in which are stored control tables for determining the amount of inserted cleanser, based on respective ones of the large, medium and small laundry quantity values, in accordance with the optical transmission factor and the saturation interval $T_s$. The microcomputer 16 also includes control means 23 for selecting one of the ROM1 to ROM3 in accordance with whether the laundry quantity is determined as small, medium or large by the wash quantity judgement means 22, and for selecting the contents of the selected one of the ROM1 to ROM3 with the optical transmission factor and the saturation interval $T_s$ obtained from the transmission factor detection apparatus 19, and for controlling the cleanser insertion apparatus 24 through the power switching apparatus.

With a control apparatus for a washing machine having the above configuration, firstly a judgement is made by the wash quantity judgement means 22 as to whether the quantity of laundry items to be washed is to be classified as large, medium or small, based on the quantity value that is detected by the wash quantity sensor 17. One of the ROM1 to ROM3, which store the control tables, is then selected in accordance with the quantity value that has been determined.

Thereafter, the control means 23 detects (using the transmission factor detection apparatus 19) the optical transmission factor and the saturation interval $T_s$ of the washing liquid within the tub during washing agitation, and determines the amount of cleanser that is to be inserted, in accordance with the detected optical transmission factor and saturation interval $T_s$ and the quantity of laundry items to be washed. For example if the saturation interval $T_s$ is long and the optical transmission factor is small, then the cleanser insertion apparatus 24 would be controlled such as to insert a relatively large amount of cleanser.

CAPABILITY FOR INDUSTRIAL USE

WIth the present invention, as will be clear from the above embodiments, the duration of the washing interval, the quantity of the inserted cleanser, and the strength of water currents are determined in accordance with the saturation interval (which constitutes information indicating the type of dirt in the laundry items to be washed) and the optical transmission factor (which constitutes information indicating the amount of dirt in the laundry items). Hence the washing interval duration, the amount of inserted cleanser, and the strength of water currents can be matched to the type of dirt and quantity of dirt in the laundry items. Thus, good results can be obtained for the finished washed articles. Moreover due to the fact that the duration of the washing interval, the quantity of the inserted cleanser and the strength of water currents are determined by using control tables, it is possible to execute high-level control such as fuzzy inference control without the need to load a complex type of program such as a fuzzy inference program into the microcomputer. In addition, real-time control operation is enabled.

Furthermore due to the fact that a plurality of control tables are provided, respectively adapted to various different types of cleanser, optimum control can be achieved that is matched to the specific type of cleanser that is being used, in spite of the fact that variations in the optical transmission factor and in the saturation interval duration will occur when different types of cleanser are used.

In addition, due to the fact that control of light emission by the photo-emissive element of the transmission factor detection apparatus during a condition of clear water, even if dirt accumulates on the detection section of the transmission factor detection apparatus over a long period of use, the level of output signal from the transmission factor detection apparatus will not be lowered, and will be fixedly standardized. Thus the optical transmission factor and the saturation interval values can be detected with a high degree of accuracy over many years of use.

Moreover, due to the fact that a plurality of control tables are provided which are respectively matched to different quantities of laundry items to be washed, highly accurate control can be achieved irrespective of the amount of laundry items.

What is claimed is:

1. A control apparatus for a washing machine, comprising:

a transmission factor detection apparatus for detecting optical transmission factor of a washing liquid within a tub;

saturation condition detection means for detecting a saturation condition based on changes in an output signal produced from the transmission factor detection apparatus;

time measurement means for measuring a saturation interval which elapses from a starting time point of a washing operation until the saturation condition is detected by the saturation condition detection means;

control means for executing the washing operation by controlling a load including a motor which drives agitator vanes; and memory means having stored therein control tables for use in determining a washing interval duration, a cleanser insertion quantity, or a strength of water currents, based on the optical transmission factor and the saturation interval duration;

in which the control means compares the optical transmission factor and the saturation interval with contents of a control table of the memory means, to determine the wash interval duration, the quantity of inserted cleanser, or the strength of water currents.

2. A control apparatus for a washing machine according to claim 1, in which the saturation condition detection means, the time measurement means, control means, and memory means, are configured of a microcomputer.

3. A control apparatus for a washing machine according to claim 1, in which a plurality of control tables in accordance with respective types of cleanser are stored in the memory means, and in which the control means selects a control table from the memory means in accordance with an output signal from a cleanser judgement means, to control the washing duration, the cleanser insertion quantity, or the strength of water currents.

4. A control apparatus for a washing machine according to claim 3, in which the cleanser judgement means receives as input a value of optical transmission factor from the transmission factor detection apparatus after a predetermined time interval has elapsed following the start of a washing operation, and judges that the cleanser is a liquid cleanser if the optical transmission factor is above a predetermined set value, and judges that the cleanser is a powder cleanser if the optical transmission factor is below the predetermined set value.

5. A control apparatus for a washing machine according to claim 1, in which the transmission factor detection apparatus comprises a photo-emitter element, a photo-receptor element, and light emission output control means, and in which the control means set in operation the light emission output control means under a condition of clear water within the tub, and sets an output signal produced from the photo-receptor element to a standard value.

6. A control apparatus for a washing machine according to claim 5, in which the control means stores in memory means output data produced from the light emission output control means, while said photo-receptor element output signal is set to the standard value.

7. A control apparatus for a washing machine according to claim 1, further comprising wash quantity detection means for detecting an amount of laundry items which are to be washed within the tub, wash quantity judgement means for classifying a value of quantity of the laundry items obtained by the wash quantity detection means within a plurality of stepwise-varying values, in which a plurality of control tables are stored in memory means respectively in accordance with the stepwise-varying values of quantity, and in which the control means selects the control tables in accordance with an output signal produced from the wash quantity judgement means, and determines the washing operation duration, the cleanser quantity insertion amount, or the strength of water currents.

* * * * *